US011400475B1

(12) United States Patent
Spigener

(10) Patent No.: US 11,400,475 B1
(45) Date of Patent: Aug. 2, 2022

(54) DROP CLOTH FOR CEILING FIXTURE

(71) Applicant: James Spigener, Baytown, TX (US)

(72) Inventor: James Spigener, Baytown, TX (US)

( * ) Notice: Subject to any disclaimer, the term of this patent is extended or adjusted under 35 U.S.C. 154(b) by 0 days.

(21) Appl. No.: 17/120,836

(22) Filed: Dec. 14, 2020

(51) Int. Cl.
*B05B 12/24* (2018.01)
*B44D 3/00* (2006.01)
*F04D 29/70* (2006.01)

(52) U.S. Cl.
CPC ..... *B05B 12/24* (2018.02); *B44D 3/00* (2013.01); *F04D 29/703* (2013.01)

(58) Field of Classification Search
None
See application file for complete search history.

(56) References Cited

U.S. PATENT DOCUMENTS 2,923,463 A * 2/1960 Shunkwilerevan ... F04D 29/703 416/247 R
5,281,093 A * 1/1994 Sedlak ..... F04D 29/38 416/62
5,582,115 A * 12/1996 Muller ..... A47C 31/116 135/96
5,591,005 A * 1/1997 McCready ..... F04D 29/388 112/475.08
5,868,189 A * 2/1999 Jarvis ..... B63H 7/02 150/165
6,394,757 B1 * 5/2002 Lackey ..... F04D 25/088 416/244 R
6,619,920 B1 * 9/2003 Cannon ..... F04D 29/70 416/62
6,916,217 B1 * 7/2005 Crepeau ..... B63B 17/00 440/71
8,100,652 B2 * 1/2012 Bauer ..... F04D 25/088 416/247 R
8,342,806 B1 1/2013 Stabe, Jr.
8,734,106 B2 5/2014 May et al.
2010/0008777 A1 1/2010 Bauer et al.
2011/0305571 A1 12/2011 Heim et al.
2020/0173447 A1 * 6/2020 Hadden ..... F04D 25/088

OTHER PUBLICATIONS

Hanging Chandelier ceiling light cover chandelier wedding decor Cascading rose petal light cover Mood setting very CHIC. Product Listing [online], © 2020 Etsy, Inc. [retrieved on Dec. 11, 2020]. Retrieved from the Internet: <URL: https://www.etsy.com/listing/86583658/hanging-chandelier-ceiling-light-cover? show_sold_out_detail-1&ref=nla_listing_details>.

* cited by examiner

*Primary Examiner* — Jethro M. Pence
(74) *Attorney, Agent, or Firm* — Cramer Patent & Design, PLLC; Aaron R. Cramer

(57) ABSTRACT

A drop cloth is configured to wrap around an enclose a ceiling-mounted light fixture with an attached fan. The drop cloth has a plurality of seams that are capable of being selectively closed to accommodate different sizes of fans and motors and light fixtures via a removable fastener. A cinching cord is disposed at the bottom.

19 Claims, 6 Drawing Sheets

DROP CLOTH FOR CEILING FIXTURE

RELATED APPLICATIONS

None.

FIELD OF THE INVENTION

The presently disclosed subject matter is directed to a drop cloth and more specifically to a drop cloth for a ceiling fixture.

BACKGROUND OF THE INVENTION

Painting is a part of almost all new construction, remodeling and even maintenance projects. Like all projects, time spent in the preparation phase helps the project itself move along quickly and smoothly in a minimal amount of time. However, one part of the painting preparation process that takes an inordinate amount of time is that of setting down drop cloths, plastic sheets, newspapers or other material to catch drips, spills, or splatters that occur when painting.

One particularly item to be masked off that is particularly aggravating do to its large and unsymmetrical shape, is that of a ceiling fan or chandelier. One may spend up to 15-20 minutes covering such fixtures with drop cloths and masking off the edge surfaces, for a painting operation that will only take 1-2 minutes. Accordingly, there exists a need for a means by which ceiling fans, chandeliers, and other similar objects can be quickly and easily temporarily covered to protect them while painting. The development of the drop cloth for ceiling fixture fulfills this need.

SUMMARY OF THE INVENTION

The principles of the present invention provide for a drop cloth that has an upper section which has an open tubular design, a lower section which has an open tubular design, a first side seam which is disposed in a vertical fashion on both the upper section and the lower section, a first fastener which secures the upper section and the lower section together in a closed position, an upper interior edge which is disposed on top of the upper section, a drawstring closure which is disposed around a lower edge of the lower section, an extension cover having a top flare section, a middle tube cover, a bottom flare section utilized with a plurality of extension drop rods from the ceiling fan or a plurality of long extension chains from the chandelier, a strap having a second fastener and an attachment means securing the lower edge of the lower section.

The upper section is placed around an upper escutcheon plate of a ceiling fan or a chandelier and the upper escutcheon plate is abutted to a ceiling surface. The upper section is placed atop the lower section. The strap allows the upper interior edge to be tightened along a cinch loop and secured on itself to eliminate a need for other attachment. The attachment means is looped upward and is forming a sleeve in which a drawstring is routed.

A rubber flange may be attached to the upper section and is secured against the upper escutcheon plate by friction fit, thus forming a masked-off paint edge on the ceiling surface. The drop cloth may comprise a neoprene flange that is attached to the upper section and is secured against the upper escutcheon plate by friction fit, thus forming a masked-off paint edge on the ceiling surface. The upper section may be made of a material selected from the group consisting of a lightweight painter grade canvas drop cloth, a piece of plastic sheeting, or a piece of Tyvek® sheeting. The lower section may be placed around a fan motor housing and blades of the ceiling fan.

The upper section and the lower section may have an overall envelope shape to accommodate covering the ceiling fan or the chandelier. The upper section may smaller than the lower section. The lower section may be made of a material selected from the group consisting of a lightweight painter grade canvas drop cloth, a piece of plastic sheeting, or a piece of Tyvek® sheeting. The first side seam may secure the drop cloth in place while the drawstring closure is pulled tight. The first fastener may be a hook and loop fastener. The hook and loop fastener may allow the drop cloth to be opened when placed around the ceiling fan and also when removing the drop cloth.

The hook and loop fastener may allow the drop cloth to be opened when placed around the chandelier and also when removing the drop cloth. The drawstring closure may be completely closed to prevent any airborne propelled paint droplets from spray painting depositing onto the drop cloth. Complete closure of the drawstring closure may be unnecessary during brush painting or roller painting as gravity will prevent errant paint droplets from depositing onto the drop cloth. The top flare section may attach to the upper escutcheon plate. The middle tube cover may cover the extension drop rods or the extension chains.

The bottom flare section may mate with the upper section allowing for a paint proof covering with the drop cloth covering the ceiling fan or the chandelier. The extension cover may be provided with a second side seam to allow for easy application and removal. The strap may be made of Nylon. The second fastener may be a hook and loop type of fastener.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
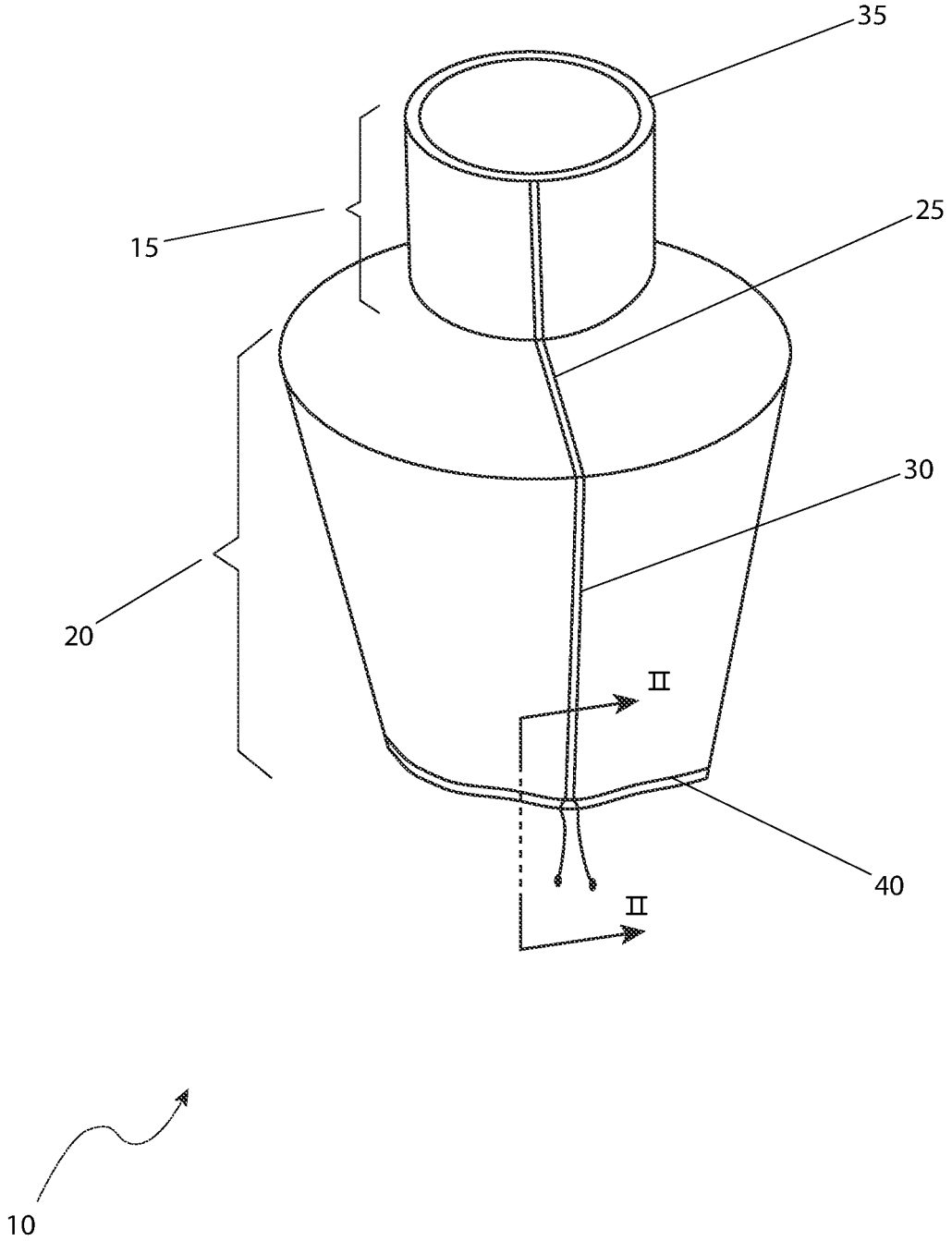
FIG. 1 is an isometric view of the drop cloth, according to the preferred embodiment of the present invention.

10 drop cloth
15 upper section
20 lower section
25 first side seam
30 first fastener
35 upper interior edge

40 drawstring closure
45 ceiling fan
50 escutcheon plate
55 fan motor housing
60 blades
65 chandelier
70 extension cover
75 top flare section
80 middle tube cover
85 bottom flare section
90 second side seam
95 ceiling surface
100 flange
105 paint edge
110 nylon strap
115 second fastener
120 cinch loop
125 attachment means
130 sleeve
135 drawstring
140 tie end

DESCRIPTION OF THE PREFERRED EMBODIMENTS

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, an isometric view of the drop cloth 10, according to the preferred embodiment of the present invention is disclosed. The drop cloth 10, is used to cover and protect ceiling fans 45, chandeliers 65, and similar ceiling fixtures during painting operations. The drop cloth 10 includes a smaller upper section 15 of an open tubular design, placed atop a larger lower section 20 also of an open tubular design. The drop cloth 10 would be made available in multiple sizes, however a typical size drop cloth 10 would have dimensions of twenty inches (20 in.) in diameter, and a height of sixteen inches (16 in.) for the upper section 15 and sixty-six inches (66 in.) in diameter, and a height of thirty inches (30 in.) for the lower section 20. The upper section 15 and the lower section 20 could be made of a variety of materials including a lightweight canvas drop cloth (painter grade), plastic sheeting, Tyvek®, paper or the like. The exact dimensions and material of construction of the drop cloth 10 is not intended to be a limiting factor of the present invention.

It is noted that the overall shape of the upper section 15 and the lower section 20 is similar to the overall envelope shape of a ceiling fan 45 or chandelier 65. A first side seam 25 is arranged in a vertical fashion on both the upper section 15 and the lower section 20. It is secured in a closed state by a first fastener 30, preferably in the guise of a hook-and-loop type of fastener such as Velcro®. It allows the drop cloth 10 to be opened when initially placed around the ceiling fan 45 or chandelier 65 and also when removing the drop cloth 10. An upper interior edge 35 is provided at the top of the upper section 15 while a drawstring closure 40 is provided around the lower edge of the lower section 20. Further description of both the upper interior edge 35 and the drawstring closure 40 will be provided herein below.

Figure 2:
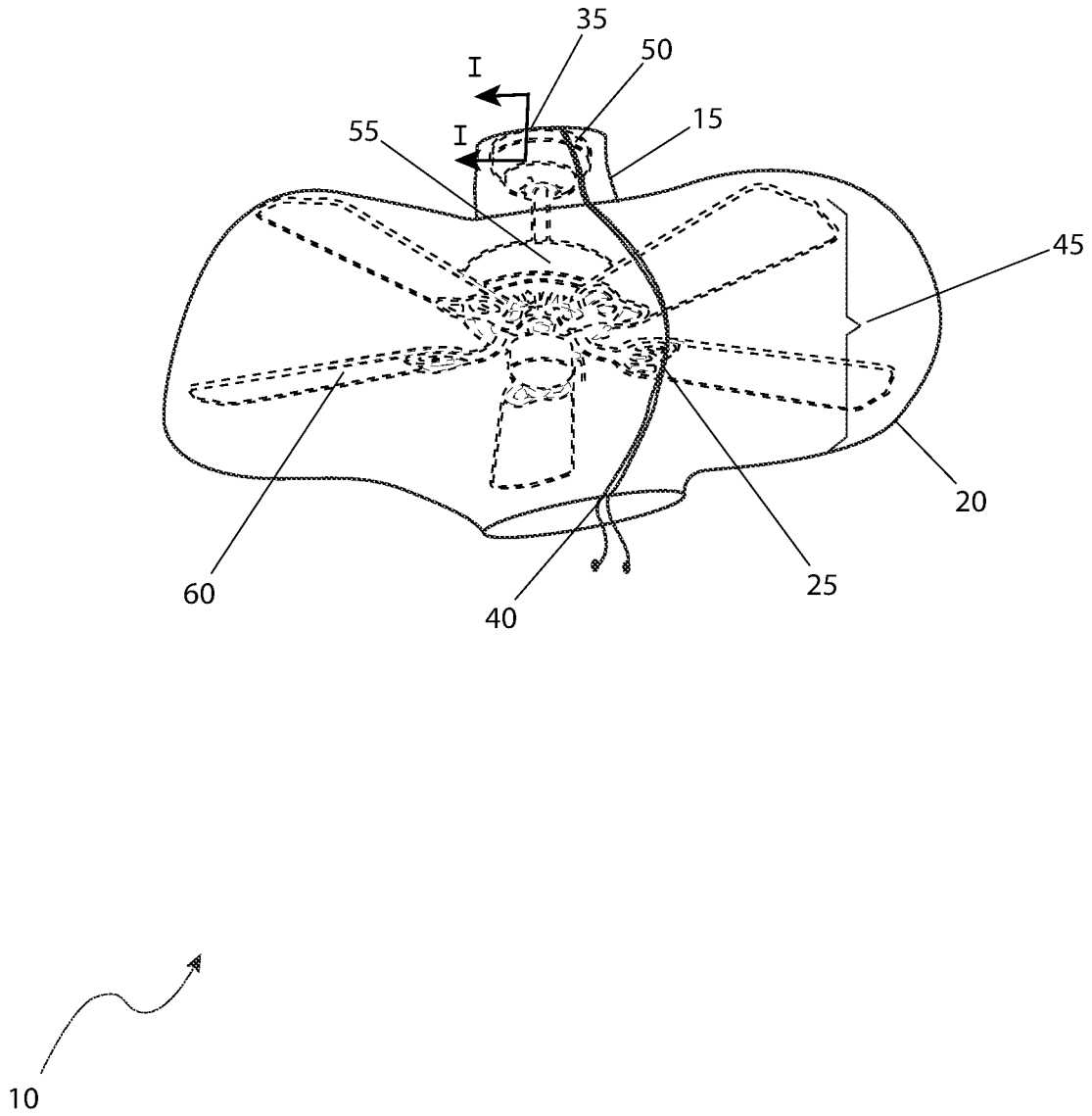
FIG. 2 is an isometric view of the drop cloth, shown in an installed state on a ceiling fan, according to the preferred embodiment of the present invention.

Referring next to FIG. 2, an isometric view of the drop cloth 10, shown in an installed state on a ceiling fan 45, according to the preferred embodiment of the present invention is depicted. The ceiling fan 45 is represented as typical in design and is shown via dashed lines due to its hidden state. The ceiling fan 45 may possess varying attributes such as outside fan blade 60 diameter, number of fan blades 60, the inclusion of a hanging light or the like. These varying attributes are accommodated by the teachings of the present invention. The upper section 15 is placed around an upper escutcheon plate 50 while the lower section 20 is placed around the fan motor housing 55 and blades 60. The first side seam 25 secures the drop cloth 10 in place while the drawstring closure 40 is pulled tight. It is noted that complete closure of the drawstring closure 40 is not necessary in the instance of brush or roller painting as gravity will prevent the entrance of errant paint droplets into the interior of the drop cloth 10. However, in the instance of spray painting, the drawstring closure 40 should be completely closed to prevent the entrance of any airborne propelled paint droplets. Further description of the attachment of the upper interior edge 35 to the escutcheon plate 50 will be provided herein below.

Figure 3:
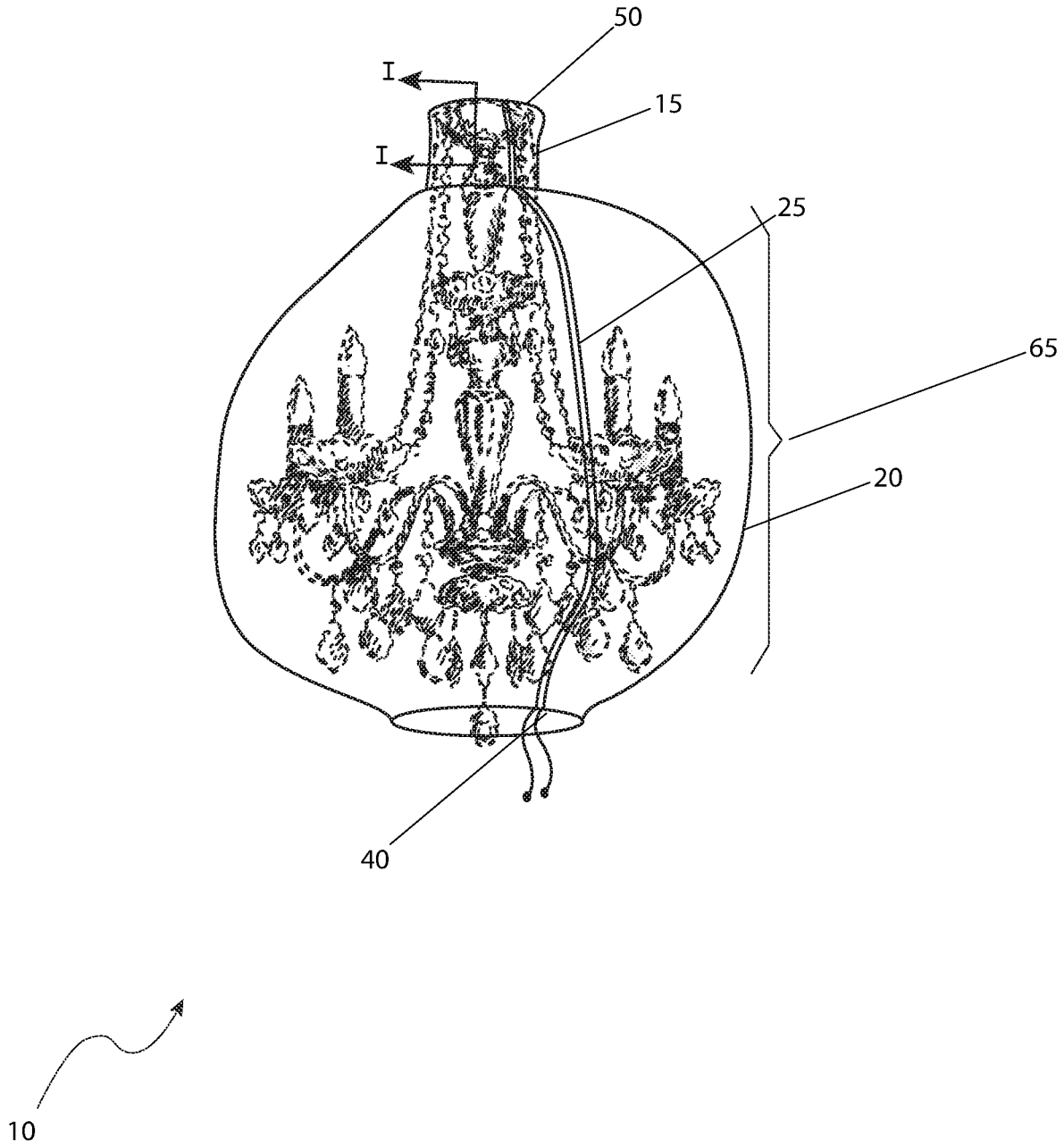
FIG. 3 is an isometric view of the drop cloth, shown in an installed state on a chandelier, according to the preferred embodiment of the present invention.

Referring now to FIG. 3, an isometric view of the drop cloth 10, shown in an installed state on a chandelier 65, according to the preferred embodiment of the present invention is shown. The chandelier 65 is represented as typical in design and is shown via dashed lines due to its hidden state. The chandelier 65 may possess varying attributes such as varying height and widths, number of lamps, or the like. These varying attributes are accommodated by the teachings of the present invention. The upper section 15 is placed around the upper escutcheon plate 50 while the lower section 20 is placed around the chandelier 65. The first side seam 25 secures the drop cloth 10 in place while the drawstring closure 40 is pulled tight. It is noted that complete closure of the drawstring closure 40 is not necessary in the instance of brush or roller painting as gravity will prevent the entrance of errant paint droplets into the interior of the drop cloth 10. However, in the instance of spray painting, the drawstring closure 40 should be completely closed to prevent the entrance of any airborne propelled paint droplets. Further description of the attachment of the upper interior edge 35 to the escutcheon plate 50 will be provided herein below.

Figure 4:
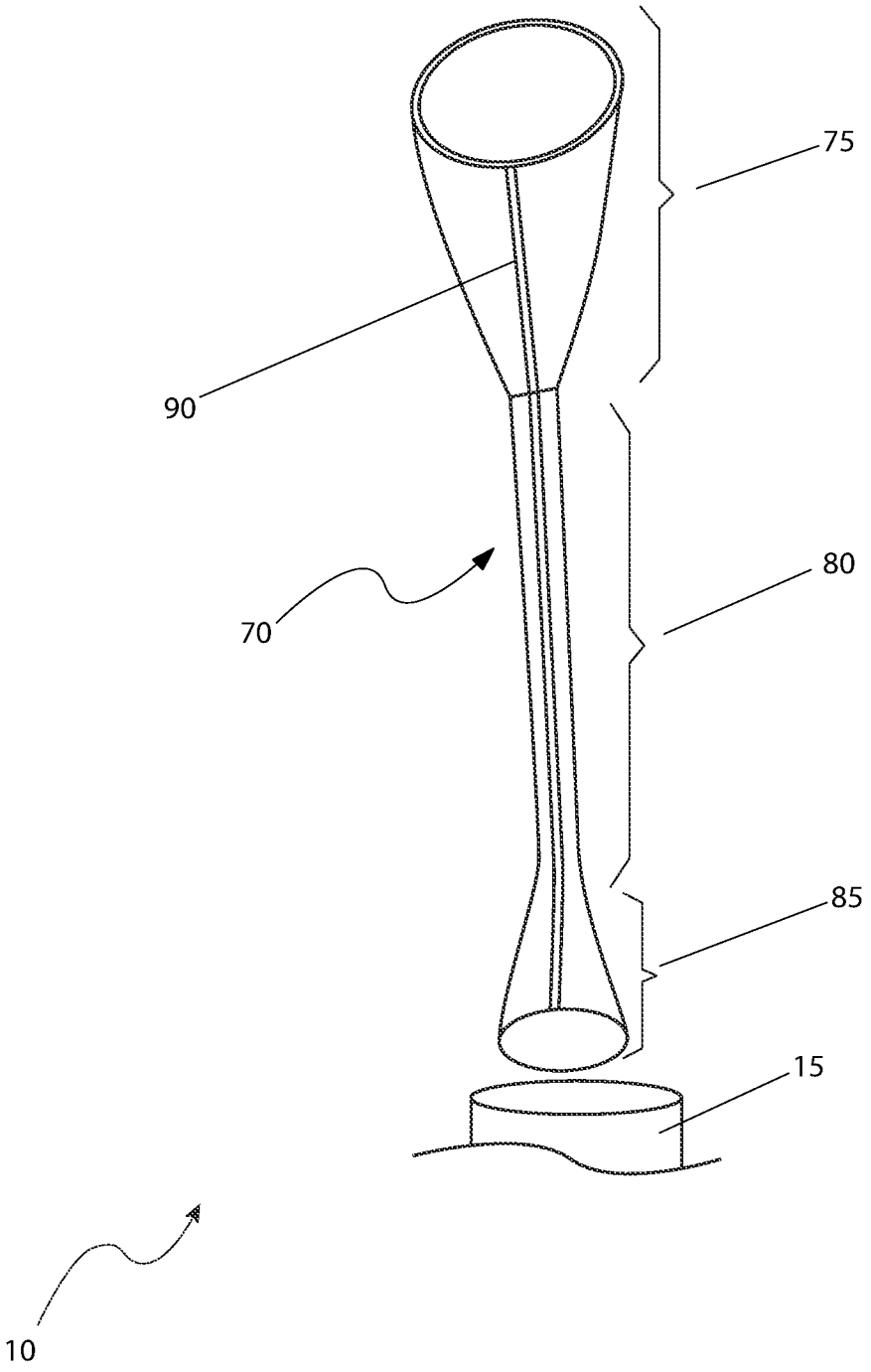
FIG. 4 is an isometric view of the extension cover, as used with the drop cloth, according to the preferred embodiment of the present invention.

Referring next to FIG. 4, an isometric view of the extension cover 70, as used with the drop cloth 10, according to the preferred embodiment of the present invention is disclosed. The extension cover 70 is used with extension drop rods as used with a ceiling fan 45 (as shown in FIG. 2) or with long extension chains as used with a chandelier 65 (as shown in FIG. 3). These instances of long extensions may be beyond the capabilities of accommodation of the drop cloth 10. The construction of the extension cover 70 is similar to that of the drop cloth 10 with a top flare section 75, a middle tube cover 80 and a bottom flare section 85. The top flare section 75 will attach the escutcheon plate 50 (as shown in FIG. 1 and FIG. 2) while the middle tube cover 80 covers the extension drop rod or the extension chain. The bottom flare section 85 will mate with the upper section 15 as shown, allowing for a paint proof covering along with the drop cloth 10 covering the balance of the ceiling fan 45 or the chandelier 65. The extension cover 70 is provided with a second side seam 90 to allow for easy application and removal. The approximate dimensions of the top flare section 75 are twelve inches (12 in.) in diameter with a length of eight inches (8 in.). The approximate diameter of the middle tube cover 80 is three inches (3 in.), and the overall length of the middle tube cover 80 and the bottom flare section 85 is a total of seventy-two inches (72 in.).

Figure 5:
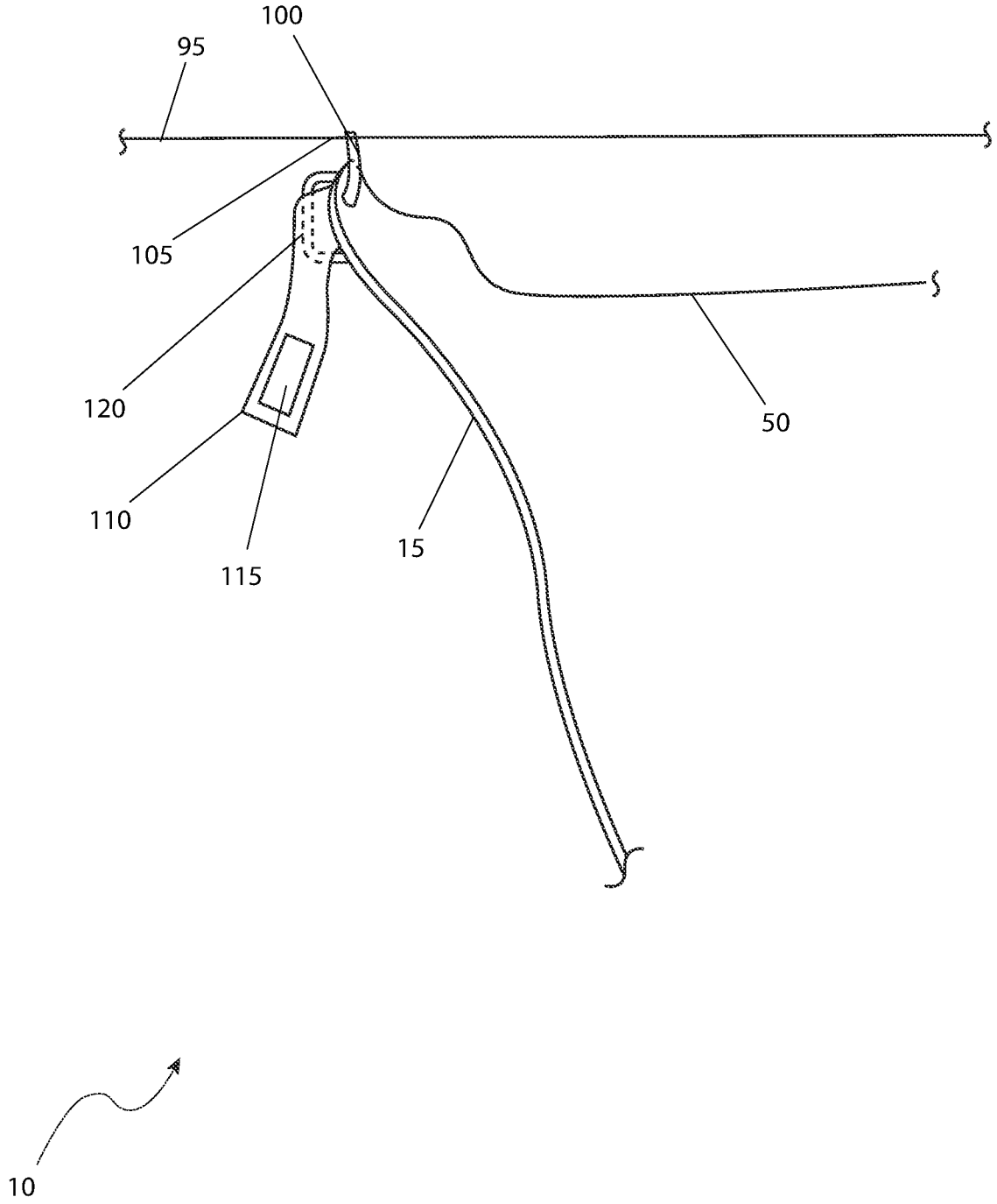
FIG. 5, is a sectional view of the drop cloth, as seen along a line I-I, as shown in FIG. 2 and FIG. 3, according to the preferred embodiment of the present invention.

Referring now to FIG. 5, a sectional view of the drop cloth 10, as seen along a line I-I, as shown in FIG. 2 and FIG. 3, according to the preferred embodiment of the present invention is depicted. The escutcheon plate 50, as used with either the ceiling fan 45 (as shown in FIG. 2) or the chandelier 65 (as shown in FIG. 3), is abutted to a ceiling surface 95. A rubber or neoprene flange 100, attached to the upper section 15 by sewing, adhesive, or similar means is secured against the escutcheon plate 50 by friction fit, thus forming a masked-off paint edge 105 on the ceiling surface 95. A nylon strap 110, provided with securement of a second fastener 115, also preferably a hook-and-loop-type of fastener, such as Velcro® allows the upper interior edge 35 to be tightened along a cinch loop 120 and secured on itself. This arrangement eliminates the need for tape or other attachment/securement methods.

Figure 6:
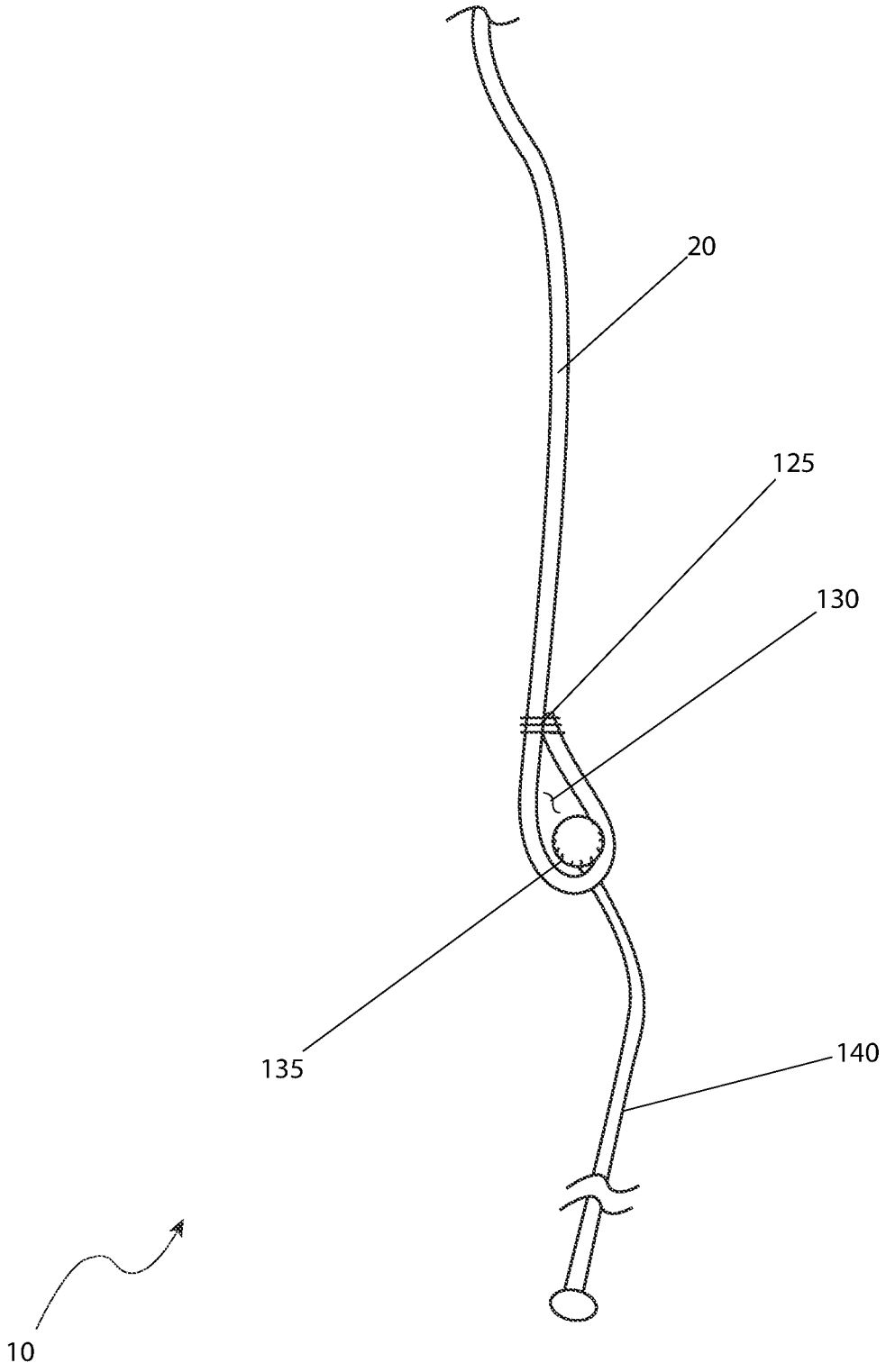
FIG. 6, is a sectional view of the drop cloth, as seen along a line II-II, as shown in FIG. 1, according to the preferred embodiment of the present invention.

Referring finally to FIG. 6, a sectional view of the drop cloth 10, as seen along a line II-II, as shown in FIG. 1, according to the preferred embodiment of the present invention is shown. The lower edge of the lower section 20 is looped upward and secured via an attachment means 125 such as sewing or adhesive, thus forming a sleeve 130 in which the drawstring 135 is routed. The distal ends of the drawstring 135 form tie ends 140 which hang free from the lower section 20. It is noted that the tie ends 140 align with the first side seam 25 (as shown in FIG. 1) to allow for complete opening of the drop cloth 10 and placement around the ceiling fan 45 (as shown in FIG. 2) or the chandelier 65 (as shown in FIG. 3) from the sides.

2. Operation of the Preferred Embodiment

The preferred embodiment of the present invention can be utilized by the common user in a simple and effortless manner with little or no training. It is envisioned that the drop cloth 10 would be constructed in general accordance with FIG. 1 through FIG. 6. The user would procure the drop cloth 10 from conventional procurement channels such as hardware stores, home improvement stores, paint supply stores, mail order and internet supply houses and the like. Special attention would be paid to the overall size of the drop cloth 10 as well as the material of construction.

During utilization of the drop cloth 10, the following procedure would be initiated: the drawstring closure 40 would be completely opened; the first side seam 25 would be completely opened; the flange 100 secured against the escutcheon plate 50, the nylon strap 110 would be tightened against the cinch loop 120 and secured with the second fastener 115; the first side seam 25 would be closed; and the tie ends 140 pulled tight.

Should the ceiling fan 45 or chandelier 65 be equipped with a long drop rod or extension chain, the extension cover 70 would be utilized prior as follows: the extension cover 70 would be completely opened; the second side seam 90 would be completely opened; the flange 100 of the top flare section 75 secured against the escutcheon plate 50, the nylon strap 110 of the top flare section 75 would be tightened against the cinch loop 120 of the top flare section 75 and secured with the second fastener 115 of the top flare section 75; the second fastener 115 would be closed; and the drop cloth 10 attached to the bottom flare section 85 in a manner as aforementioned described.

After use of the drop cloth 10, it is simply removed following the reverse of the procedure aforementioned described.

The features of the present invention, provide the following benefits: the drop cloth 10 is easily secured using the nylon strap 110 and the second fastener 115, the elimination of the tape, paper, and/or plastic as masking material and the subsequent ecologically unfriendly disposal in landfills, reduced time to protect ceiling fan 45 and chandelier 65 prior to painting, and the ability to repeatedly use the drop cloth 10 over and over.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A drop cloth, comprising:

an upper section having an open tubular design, the upper section is placed around an upper escutcheon plate of a ceiling fan or a chandelier and the upper escutcheon plate is abutted to a ceiling surface;

a lower section having an open tubular design, the upper section is placed atop the lower section;

a first side seam disposed in a vertical fashion on both the upper section and the lower section;

a first fastener securing the upper section and the lower section together in a closed position;

an upper interior edge disposed on top of the upper section;

a drawstring closure disposed around a lower edge of the lower section;

an extension cover having a top flare section, a middle tube cover, and a bottom flare section;

a strap having a second fastener, the strap allowing the upper interior edge to be tightened along a cinch loop and secured on itself to eliminate a need for other attachment; and an attachment means securing the lower edge of the lower section, the attachment means is looped upward and is forming a sleeve in which a drawstring is routed.

2. The drop cloth, according to claim 1, further comprising a rubber flange that is attached to the upper section and is secured against the upper escutcheon plate by friction fit, thus forming a masked-off paint edge on the ceiling surface.

3. The drop cloth, according to claim 1, further comprising a neoprene flange that is attached to the upper section and is secured against the upper escutcheon plate by friction fit, thus forming a masked-off paint edge on the ceiling surface.

4. The drop cloth, according to claim 1, wherein the upper section is made of a material selected from the group consisting of a lightweight painter grade canvas drop cloth, a piece of plastic sheeting, or a piece of Tyvek® sheeting.

5. The drop cloth, according to claim 1, wherein the lower section is placed around a fan motor housing and blades of the ceiling fan.

6. The drop cloth, according to claim 1, wherein the upper section and the lower section have an overall envelope shape to accommodate covering the ceiling fan or the chandelier.

7. The drop cloth, according to claim 1, wherein the upper section is smaller than the lower section.

8. The drop cloth, according to claim 1, wherein the lower section is made of a material selected from the group consisting of a lightweight painter grade canvas drop cloth, a piece of plastic sheeting, or a piece of Tyvek® sheeting.

9. The drop cloth, according to claim 1, wherein the first side seam secures the drop cloth in place while the drawstring closure is pulled tight.

10. The drop cloth, according to claim 1, wherein the first fastener is a hook and loop fastener.

11. The drop cloth, according to claim 10, wherein the hook and loop fastener allows the drop cloth to be opened when placed around the ceiling fan and also when removing the drop cloth.

12. The drop cloth, according to claim 10, wherein the hook and loop fastener allows the drop cloth to be opened when placed around the chandelier and also when removing the drop cloth.

13. The drop cloth, according to claim 1, wherein the drawstring closure is completely closed to prevent any airborne propelled paint droplets from spray painting depositing onto the drop cloth.

14. The drop cloth, according to claim 1, wherein complete closure of the drawstring closure is unnecessary during brush painting or roller painting as gravity will prevent errant paint droplets from depositing onto the drop cloth.

15. The drop cloth, according to claim 1, wherein the top flare section attaches to the upper escutcheon plate.

16. The drop cloth, according to claim 1, wherein the bottom flare section mates with the upper section allowing for a paint proof covering with the drop cloth covering the ceiling fan or the chandelier.

17. The drop cloth, according to claim 1, wherein the extension cover is provided with a second side seam to allow for easy application and removal.

18. The drop cloth, according to claim 1, wherein the strap is made of Nylon.

19. The drop cloth, according to claim 1, wherein the second fastener is a hook and loop type of fastener.

* * * * *